United States Patent [19]

Grimaldo

[11] Patent Number: 4,967,585

[45] Date of Patent: Nov. 6, 1990

[54] BENDING DIE AND RAM ASSEMBLY FOR TUBE BENDING MACHINE

[76] Inventor: Samuel Grimaldo, 2539 Teller Rd., Newbury Park, Calif. 91320

[21] Appl. No.: 346,709

[22] Filed: Jun. 12, 1989

[51] Int. Cl.[5] ..... B21D 7/06

[52] U.S. Cl. ..... 72/389; 72/482

[58] Field of Search ..... 72/380, 389, 212, 213, 72/481, 482, 462, 312, 373

[56] References Cited

U.S. PATENT DOCUMENTS

| | | | |
|---|---|---|---|
| 1,662,428 | 3/1928 | Lowe . | |
| 1,765,807 | 6/1930 | Thomas | 72/465 |
| 3,388,574 | 6/1968 | Ignoffo . | |
| 3,429,157 | 2/1969 | Huth . | |
| 3,499,309 | 3/1970 | Gregg . | |
| 3,727,449 | 4/1973 | Johnston . | |
| 3,756,058 | 9/1973 | Hamkins et al. . | |
| 4,206,629 | 6/1980 | Grimaldo . | |
| 4,299,113 | 11/1981 | Belotti | 72/389 |
| 4,833,907 | 5/1989 | Grimaldo | 72/389 |

FOREIGN PATENT DOCUMENTS

| | | | |
|---|---|---|---|
| 3711970 | 10/1988 | Fed. Rep. of Germany | 72/389 |
| 84/04475 | 11/1984 | World Int. Prop. O. | 72/481 |

*Primary Examiner*—David Jones

*Attorney, Agent, or Firm*—Kelly, Bauersfeld & Lowry

[57] ABSTRACT

An improved bending die and ram assembly is provided for use in a tube bending machine used for bending metal tubing of the type used, for example, in vehicle exhaust systems and the like. The machine features a bending die having a convexly curved die face for bending engagement with a metal tube supported by a pair of backshoe dies mounted on an outwardly pivoting pair of back gates. The bending die is advanced by the ram assembly along a line extending between the back gates to engage and bend the metal tube, with the back gates swinging outwardly in opposite directions as the tube is bent. The ram assembly utilizes retractor hooks which cooperate with lugs projecting from the underside of the bending die to permit the die to be attached and detached from the ram assembly in a drop-in, lift-out manner that does not require tools. Following a bending operation, the retractor hooks engage the lugs to pull the bending die away from bent tube during retraction of the ram assembly.

20 Claims, 2 Drawing Sheets

FIG. 4
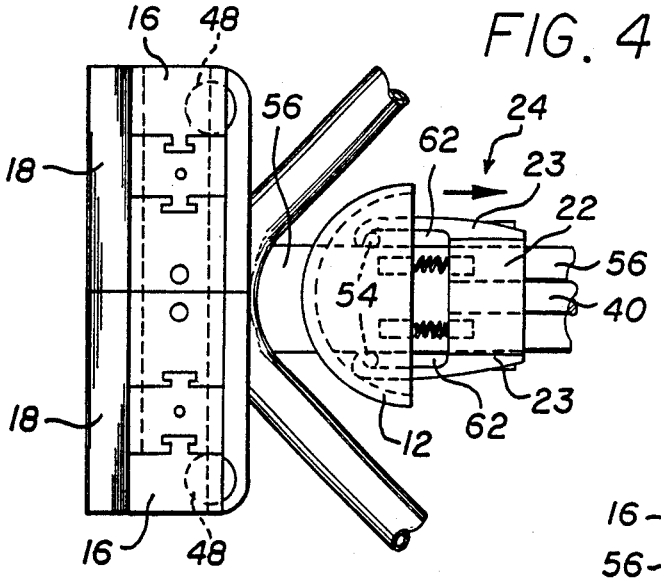
FIG. 3
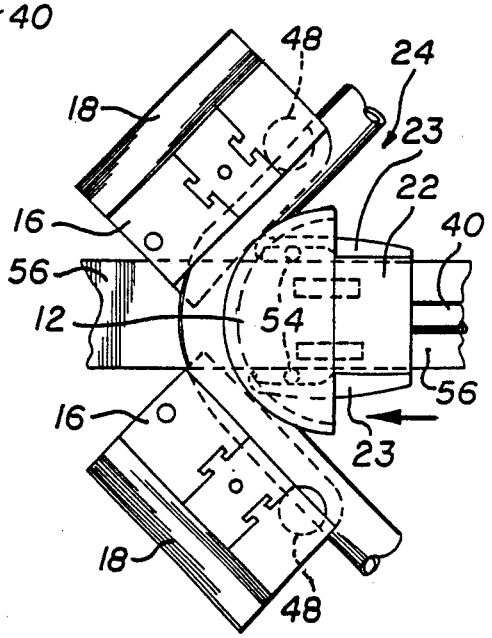
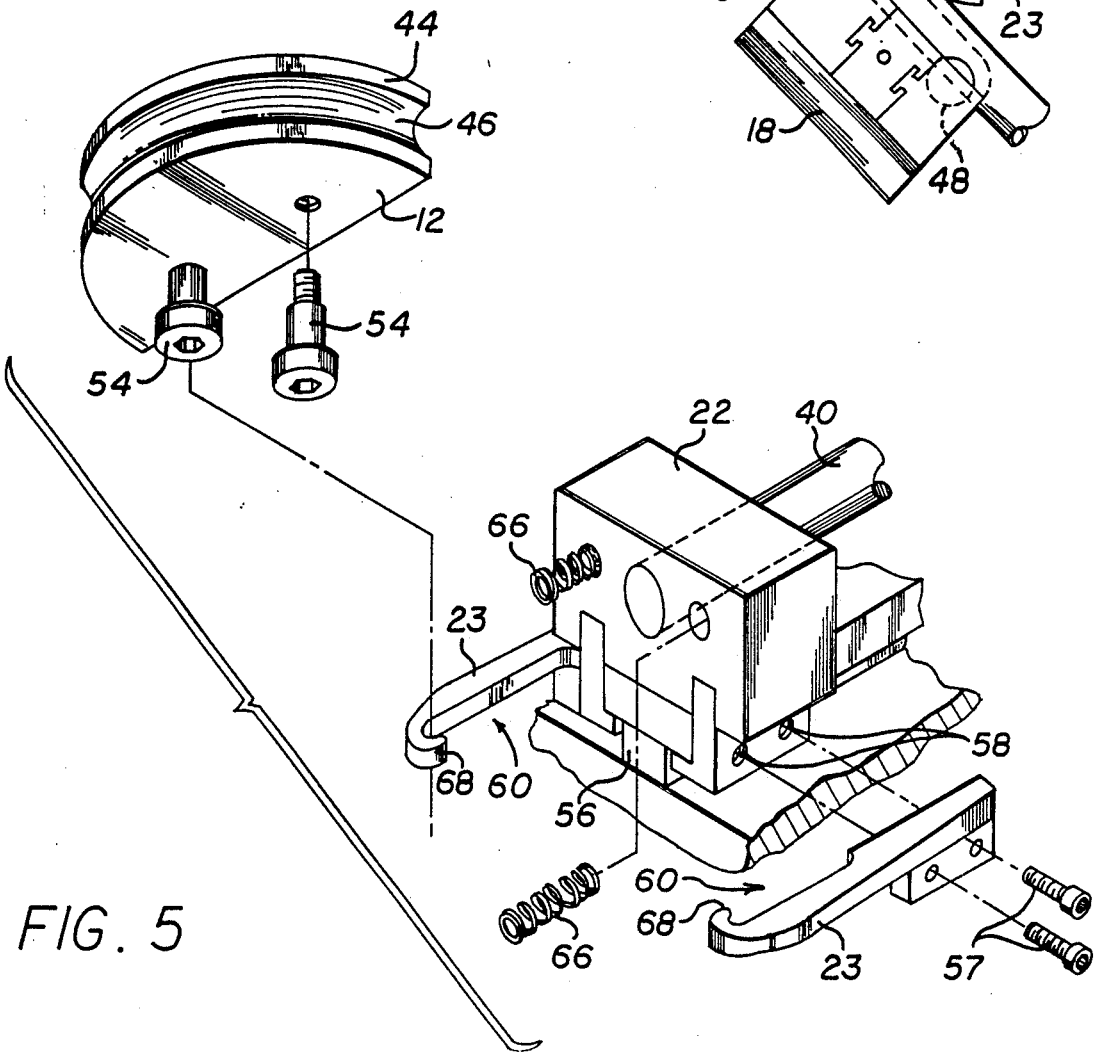
FIG. 5

BENDING DIE AND RAM ASSEMBLY FOR TUBE BENDING MACHINE

BACKGROUND OF THE INVENTION

This invention relates generally to improvements in radius bending dies of the type used in tube bending machines for bending metal tubing or the like to a selected configuration, wherein such bent tubing may be used, for example, in vehicular exhaust and tailpipe systems, etc. More particularly, this invention relates to an improved bending die that is detachably secured within a novel ram assembly which enables the bending die to be mounted onto the tube bending machine in an efficient, drop-in manner that allows various sized bending dies to be interchanged without the use of accessory tools.

Tube bending machines in general are relatively well known in the art for use in bending metal tubing to a selected configuration. Such tube bending machines are commonly used by automotive vehicle repair shops to shape a length of metal tubing in a customized fashion for use in a vehicle exhaust or tailpipe system. A typical tube bending machine includes a bending die carried by a hydraulic ram for advancement into bending engagement with a length of metal tubing supported by a pair of backshoe dies mounted respectively on an outwardly pivoting pair of back gates. The bending die has a convexly curved, typically semicircularly shaped bending die face which cooperates with complementary die faces of the backshoe dies to define a channel of generally circular cross section having a diametric size closely matching the size of metal tube being bent by the machine. The bending die is advanced along a line extending between the pivot axes of the back gates and pushes into the supported metal tube, thereby causing the back gates with their backshoe dies to react by pivoting outwardly in unison and in opposite directions away from the bending die. This combination of bending die and back gate pivoting motion cooperates to bend the metal tube through a selected angle, in accordance with the advancement stroke length of the bending die.

One commercial example of a tube bending machine of this general type is marketed under the trademark BLUE BOY, by American Machine & Hydraulics, Inc., of Newbury Park, Calif. See also U.S. Pat. No. 3,388,574.

A major problem previously associated with mounting the bending die arises from the need to interchange bending dies of different radius of curvature in order to bend tubing into a desired configuration. Many prior bending dies cannot be rapidly detached and substituted by a different, appropriately sized die. Another general problem encountered with use of bending dies occurs during retraction of the bending die from the bent tubing, when tubing engagement forces and/or slight tubing compression can cause the bending die to stick or hang up on the tubing. Positive mechanical retraction of the bending die is needed for these reasons, but prior mechanical arrangements for positive retraction have been incompatible with simple die changeover.

In one common bending die mounting configuration, the bending die includes two rearwardly extending pins for sliding reception into open bores in a pusher block carried by the hydraulic ram. A mechanical stop is interlocked with at least one of the pins so that when the pusher block is retracted, the mechanical stop is engaged by the pusher block to retract the bending die. In this attachment arrangement, bending die removal is prohibited unless the mechanical stop is first removed. Accordingly, manipulative steps often requiring the use of tools are required to change bending dies. Moreover, removal of parts such as mechanical stops can result in the parts being misplaced or lost, causing further delays in machine operation.

Other prior mounting configurations have been designed to permit faster changeover of the bending die. For example, the pusher block has been provided with a hinged mechanical clamp or with upstanding pins to interlock with an appropriately apertured bending die, to permit bending die installation or removal without separate mechanical retractor stops. However, such past solutions generally have been less than ideal.

There exists, therefore, a significant need for an improved bending die which can be mounted onto the pusher block in a manner that permits the bending die to be easily and quickly changed without tools or accessory parts, wherein the bending die incorporates means for physically retracting the bending die from bent tubing at the conclusion of a bending step. The present invention fulfills these needs and provides further related advantages.

SUMMARY OF THE INVENTION

In accordance with the invention, an improved bending die and ram assembly is provided for bending a metal tube in a tube bending machine. The improved bending die attaches to ram means such that the bending die is normally biased outwardly therefrom and can be easily interchanged with other differently sized bending dies without requiring the use of tools or accessory parts. The bending die drops into engagement with the ram means in a manner that enables one bending die to be easily and quickly lifted out of engagement with the ram means so that another bending die can be rapidly substituted therefor. The ram means slides along a guide rail to advance the bending die during a bending operation, and the die is maintained in alignment on the rail by lugs provided on the underside of the bending die. Following the bending operation, retractor hooks on the ram means advantageously engage and positively retract the bending die away from bent tubing and prevent the bending die from rising during disengagement and retraction of the die from the bent tubing.

The tube bending machine comprises a machine frame carrying a hydraulic ram having the bending die attached thereto. The bending die has a conventional convexly curved bending die face presented toward a pair of side-by-side back gates mounted on the machine frame for swinging movement in opposite directions. Backshoe dies are mounted respectively on the back gates and cooperatively support the metal tube in a position for bending engagement by the bending die. The bending die is advanced by the ram toward the metal tube along the guide rail which extends along a line passing between the back gates and their associated backshoe dies. As the bending die engages the metal tube, the back gates and their backshoe dies are pivoted outwardly in opposite directions, with the combined die movements bending the metal tube through a selected angle. Support grooves of generally semicircular cross section are formed in the bending die and in the backshoe dies to cooperatively define a generally circular channel within which the metal tube is supported during a bending procedure, with the diametric size of this channel conforming generally with the diametric size of the tubing to be bent.

In a preferred form of the improved bending die and ram assembly associated therewith, the bending die includes a pair of downwardly projecting lugs defined by bolt heads, or the like, extending from the underside of the bending die. The bending die is easily engaged with the hydraulic ram by positioning the die in front of the ram with the bolt heads in sliding engagement with opposite sides of the guide rail. One or more compression springs react between the bending die and a ram pusher block to normally bias the bending die outwardly from the pusher block. When that the bending die initially engages the metal tube, the biasing action of the springs advantageously maintains the die in tension against the tube so that an operator can rotatably adjust the position of the tube to an orientation appropriate for the desired bend. During advancing motion, the bolt heads extending from the bending die slide along the guide rail within elongated slots cooperatively defined by the guide rail and a pair of elongated retractor hooks that extend outwardly and forwardly from the pusher block on either side of the guide rail.

A number of advantages are achieved by the use of the retractor hooks to retain the bending die with respect to the pusher block. More specifically, the retractor hooks and the bending die lugs cooperate with the guide rail to align the bending die thereon and prevent straying of the bending die to the right or left while in motion. Following a forming operation, the retractor hooks provide means for physically retracting the bending die from bent tubing, thereby preventing sticking of the bending die on the bent tubing. Such retraction can be enhanced by spacing the bolt heads sufficiently from the bending die to underlie the retractor hooks, whereby the bolt heads further prevent lifting of the die during rearward movement. Following retraction, the slots defined in part by the hooks allow for quick and easy removal of the bending die by merely sliding the bending die within the slots until the bolt heads are relocated out of interlocking engagement with the curved ends of the hooks, and then lifting the bending die out of the ram assembly.

Other features and advantages of the present invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 3 is a fragmented top plan view of a portion of the tube bending machine, illustrating the bending die cooperating with the backshoe dies to engage and bend metal tubing;

FIG. 4 is a fragmented top plan view similar to FIG. 3, depicting retraction of the bending die from the bent tubing; and FIG. 5 is an exploded, fragmented, perspective view depicting components of the bending die and ram assembly.

DETAILED DESCRIPTION OF THE PREFERRED EMBODIMENT

Figure 1:
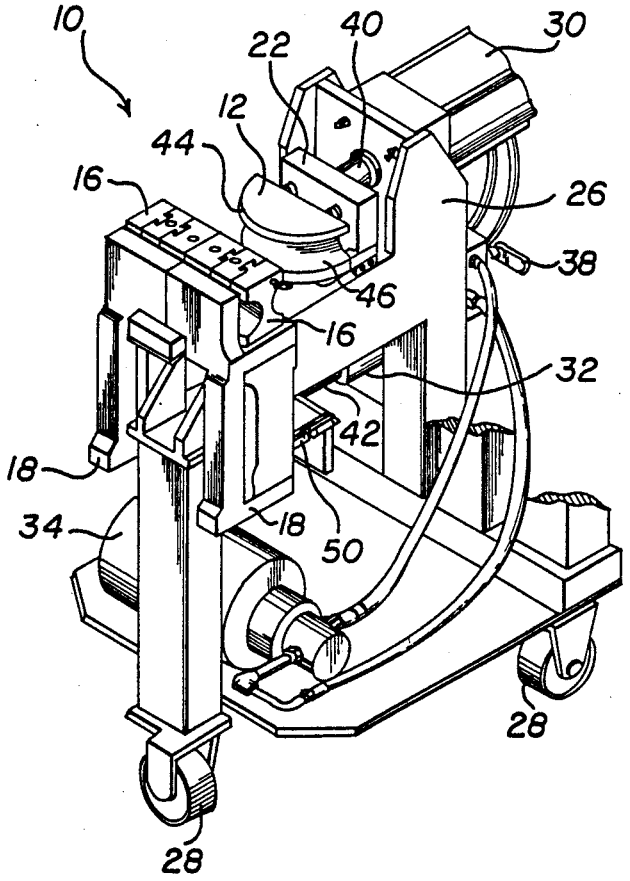
FIG. 1 is a fragmented perspective view illustrating an improved tube bending machine having a bending die and ram assembly embodying the novel features of the invention.

As shown in the exemplary drawings, an improved tube bending machine, referred to generally in FIG. 1 by the reference numeral 10, is provided for bending a metal tube particularly such as a metal tube of the type used for vehicle exhaust and tailpipe systems. The tube bending machine 10 features an improved bending die 12 movable into bending engagement with a metal tube 14 (FIG. 3) which is supported by a pair of backshoe dies 16 mounted on a pair of outwardly swinging back gates 18.

The improved bending die 12 quickly and easily attaches to a pusher block 22 having retractor hooks 23 in a simple drop-in manner to form a ram assembly 24 (FIG. 5). The bending die 12 can be rapidly detached from the pusher block 22 by merely lifting the bending die out of engagement with the retractor hooks 23. This feature of the ram assembly 24 beneficially enables multiple bending dies 12 to be interchanged without requiring the use of tools or accessory tooling die components, thereby reducing the operator time absorbed in switching bending dies as well as the number of parts which must be organized and maintained by the machine operator. The ease and speed with which bending dies can be interchanged with the present invention provides a significant advantage because vehicle exhaust systems utilize metal tubing of different standard diametric sizes and accordingly, to provide a full service tube bending capability, a machine owner is continually required to change the bending die size to match different diametric sizes of metal tubing.

The retractor hooks 23 function to alleviate a problem which is commonplace in the tube bending art, namely, the tendency for prior bending dies to stick or hang up on bent tubing following a forming operation. This problem can be caused by tubing engagement forces and/or slight tubing compression that interlock the bending die with the bent tubing. To address this problem, the retractor hooks 23 are used as a positive mechanical link for physically pulling the bending die 12 away from the bent tubing when the ram assembly 24 is hydraulically retracted. The retractor hooks 23 also serve to prevent the bending die from rising during disengagement and retraction from bent tubing. A further advantage of the present invention is that the bending die 12 is designed to maintain a predetermined path while in motion without straying to either side.

The general construction and overall operation of the tube bending machine 10 is in most respects conventional in the art. More particularly, with reference to FIG. 1, the tube bending machine 10 comprises an upright rigid machine frame 26 which is desirably supported by small rollers or caster wheels 28 for easy portability, for example, about an automobile repair shop. The machine frame 26 supports a primary hydraulic cylinder 30 and an auxiliary hydraulic cylinder 32 mounted generally one on top of the other in coplanar relation. A standard pump 34 is also carried by the frame 26 for supplying hydraulic fluid under pressure through conduits 36 to the hydraulic cylinders 30 and 32, with appropriate controls 38 being provided to control fluid porting to and from the cylinders. Such fluid porting is effective to extend and retract an upper hydraulic ram 40 associated with the primary cylinder 30 and a lower hydraulic ram 42 associated with the auxiliary cylinder 32, all in a manner known to those skilled in the art.

The upper or primary hydraulic ram 40 terminates in the pusher block 22 presented toward the backshoe dies 16. The bending die 12 is carried by the pusher block 22 for advancing movement toward the backshoe dies 16 into bending engagement with the metal tube 14, as will be described in more detail. As previously noted, this bending die 12 is adapted for rapid removable mounting onto the pusher block 22. A convexly curved die face 44 is defined by the bending die 12 and conventionally has a generally semicircular shape presented toward the backshoe dies 16. This bending die face 44 is channeled to define a recessed groove 46 of generally semicircular cross sectional shape, with the diametric size of the groove 46 corresponding closely with the diametric size of the tube to be bent. When metal tubing of a different diametric size is to be bent, the bending die 12 is removed from the machine 10 and replaced with an alternate bending die (not shown) having a recessed groove in the die face thereof sized to correspond with the diametric size of the metal tube to be bent. The alternate bending die may also have a convex plan shape formed with a different radius of curvature, if desired. The present invention enables alternate bending dies to be rapidly installed, as will be detailed hereinafter.

The bending die 12 is advanced during machine operation by the hydraulic ram 40 along a centerline passing between the two back gates 18. In this regard, as viewed best in FIG. 1, the two back gates 18 are mounted side-by-side on the machine frame 26 for individual pivoting movement about a respective pair of vertically oriented bearings 48 (FIGS. 3 and 4) positioned in laterally offset relation from the bending die path of motion. As viewed in FIGS. 3 and 4, the back gates 18 are pivotal between a closed or side-by-side position (FIGS. 1 and 4) to an open position in laterally outward spaced relation (FIG. 3). In this regard, the back gates 18 operate in generally the same manner as the tube bending machine described in U.S. Pat. No. 3,388,574, which is incorporated by reference herein. The backshoe dies 16 are geometrically shaped to provide stable support for the metal tube 14 to be bent during advancement of the bending die 12 into bending engagement with the metal tube. A preferred backshoe die construction is disclosed in copending application Ser. No. 07/128,624, now U.S. Pat. No. 4,833,907 which is incorporated by reference herein.

More particularly, the bending die 12 is advanced by the upper hydraulic ram 40 (FIG. 2) towards the backshoe dies 16. Further bending die advancement brings the die into engagement with the metal tube 14 supported by the backshoe dies 16 and causes the backshoe dies to pivot outwardly in opposite directions (FIG. 3), with the combined motion of the various dies bending the metal tube without significant disruption of the circular cross section. The angle of the bend formed in the tube 14 is functionally related to the depth of the stroke of the bending die 12, and may be suitably preset by angle control mechanisms (not shown) as described, for example, in U.S. Pat. No. 3,388,574. Moreover, the radius of curvature of the formed bend is controlled by the convex contour of the bending die face 44. For optimum machine control, the outward swinging movement of the back gates 18 is resisted by the auxiliary hydraulic ram 42 coupled by chains 50, or the like, to the back gates. After completion of the desired angle bend, the rams 40 and 42 are retracted for subsequent advancement to form another bend in the metal tube.

In accordance with the invention, the bending die 12 has two holes 52 drilled and tapped on its underside with two shoulder bolts 54 screwed into these holes. The shoulder bolts 54 define lugs which interact with the retractor hooks 23 to allow quick and easy change-over of the bending die on the machine without the use of accessory tools/parts. The ram assembly 24 (FIG. 5) is mounted for guided sliding motion in a direction toward and away from the backshoe dies 16 upon a guide rail 56. The guide rail 56 has a profile which fits into a slot in the underside of the pusher block 22 to provide a sliding engagement therebetween. The retractor hooks 23 each comprise a base having an arm extending forwardly therefrom which terminates in a curved free end. The retractor hooks 23 are secured to the pusher block 22 on opposite sides of the guide rail 56 by bolts 57 that pass through holes in the base into threaded engagement with holes 58 in the pusher block. The elongated shape of the retractor hooks provides open-sided channels 60 that cooperate with the guide rail 56 to define elongated slots 62 (FIG. 4) for retaining the heads of the shoulder bolts 54.

Figure 2:
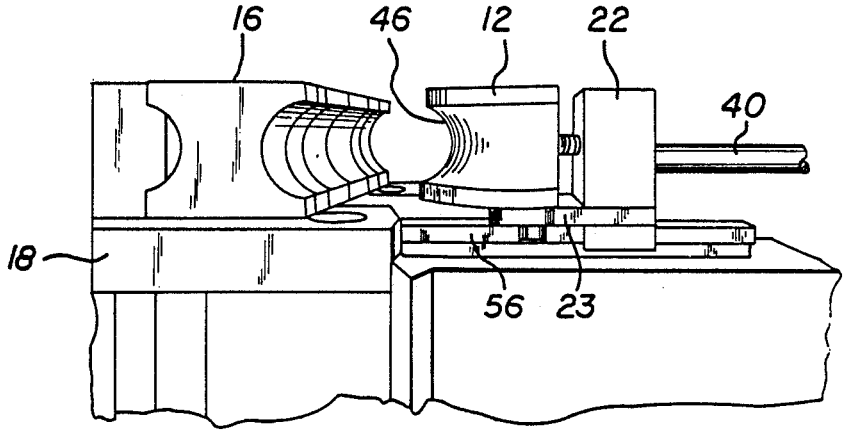
FIG. 2 is a fragmented perspective view showing the bending die and ram assembly in facing relation with backshoe dies of the machine.

The front face of the pusher block 22 has a pair of bores 64 for retaining a pair of compression springs 66 disposed between the bending die 12 and the pusher block such that the springs 66 normally bias the bending die 12 outwardly from the pusher block (FIG. 2). These springs will compress upon advancement of the bending die into engagement with the tube, and force application attributable to the bending die will substantially increase. Further forward motion of the hydraulic ram 40 will force the bending die 12 into abutment with the pusher block 22, thereby effectively removing the biasing influence of the fully compressed springs from the system and eventually causing outward swinging of the backshoe dies to bend engaged tubing (FIG. 3).

When the ram 40 is in the retracted position, the bending die 12 is easily loaded into the ram assembly 24 by lowering the die down upon the guide rail 56 in a manner allowing the heads of the shoulder bolts 54 to drop into the channels 60 in the two retractor hooks 23. The action of the springs 66 upon the bending die 12 will urge the bolts 54 along the elongated slots 62 in an outwardly or forwardly direction from the pusher block 22. However, upon installation, the bolts 54 will be spaced from curved distal or free ends 68 of the retractor hooks 23 and will not enter into a vertically interlocking engagement with the ends 68 until the retractor hooks 23 are used to retract the bending die 12 (FIG. 4). This mounting arrangement enables bending dies of different sizes to be removably attached to the front of the pusher block.

The heads of the shoulder bolts 54 ride along the sides of the guide rail 56 to beneficially keep the bending die aligned thereon and prevent the die from straying to either side while in motion. The retractor hooks 23 also cooperate with the bolts 54 to affix the bending die in alignment upon the rail.

The shoulder bolts 54 will remain retained within the elongated slots 62 throughout a bending operation. However, the location of the bolts within said slots will change, as evidenced in FIGS. 2–4. Initially, prior to engagement of the bending die 12 with the metal tube 14, the bolts 54 are normally biased into a first position (FIG. 2), whereat the bolts are spaced inwardly or rearwardly from the curved hook ends 68 and are not interlocked in the vertical sense with the ends 68. Once bending of the metal tube has been completed, retraction of the ram assembly will result in the curved retractor hook ends 68 grasping the bolts 54 such that the bolts are located within the slots 62 at a second position (FIG. 4) whereat the bolt heads are vertically interlocked with the curved hook ends 68.

Following retraction, the bending die 12 is rapidly detached from the pusher block by sliding the bending die within the slots 62 in a "return" direction toward the pusher block. This relocates the bolts 54 from the second position to the first position, thereby clearing the bolt heads from the curved hook ends 68. Once the bolts 54 are proximate the first position, an operator merely has to lift the bending die straight up to disengage the die from the ram assembly. The drop-in attachment of the bending die to the ram assembly and its lift-out detachment therefrom can advantageously be executed entirely without tools. As a further advantage, smaller sized bending dies can be installed without requiring accessory tooling components such as adapter plates.

A primary functional advantage achieved by the present invention is provided by the retractor hooks 23 upon completion of a bending operation. As the upper hydraulic ram 40 retracts the pusher block 22 away from the backshoe dies 16, the curved hook ends 68 engage the shaft diameters of the shoulder bolts 54 and draw the bolts backwardly. In this manner, the hooks 23 provide a mechanical link for pulling the bending die away from bent tubing. This advantageously prevents the bending die from sticking to the bent tubing.

In accordance with another advantage provided by use of the retractor hooks, the curved hook ends 68 fit between the underside of the bending die and the bolt heads to trap the shoulder bolt heads under the retractor hook lower surfaces so that the bending die cannot lift up during disengagement and retraction of the die from bent tubing. The bolt heads are captured in this manner in the retraction step illustrated in FIG. 4. This feature prevents the bending die from rising during retraction, thereby preventing the die from possibly marring a bent tube with an upwardly directed movement. Alternatively, the shoulder bolts 54 can be threaded completely into the underside of the bending die such that the bolt heads are flush therewith. This configuration will still position the bolt heads for engagement by the curved hook ends during retraction, without vertical interlock.

From the foregoing, it will be appreciated that the improved bending die and ram assembly of the present invention effectively provides means for physically retracting the die from engagement with bent tubing. Moreover, a savings in operational time is realized by the invention's provision for quick and easy interchangeability of the bending die in a drop-in, lift-out manner which obviates the need for tools.

A variety of modifications and improvements to the invention described herein will be apparent to those skilled in the art. Accordingly, no limitation on the invention is intended by the description herein or the accompanying drawings, except as set forth in the appended claims.

What is claimed is:

1. In a tube bending machine for bending metal tubing or the like, said machine having a machine frame, a bending die, ram means carrying said bending die and operable to advance and retract said bending die along a predetermined path, a pair of back gates, a pair of backshoe dies for mounting respectively on said back gates in positions cooperating with said bending die upon advancement of said bending die along said predetermined path to support a metal tube, and bearing means for pivotally mounting said back gates for swinging movement relative to said frame about respective axes offset to opposite sides of said predetermined path, said back gates reacting to the advancement of the bending die to bend the metal tube by pivoting outwardly from a substantially side-by-side closed position to an open position wherein said back gates are pivoted outwardly in opposite directions from each other, the improvement comprising:

means for mounting said bending die onto said ram means such that said bending die is normally biased outwardly from said ram means, wherein said bending die attaches to said mounting means in a drop-in manner, and wherein said mounting means positively retracts said bending die from bent tubing upon retraction of said ram means along said predetermined path.

2. The improvement of claim 1, wherein said mounting means is adapted such that a first bending die can be detached therefrom and a second, differently sized bending die substituted therefor, wherein following detachment of the first bending die, installation of the second bending die requires only manual vertical seating of the second bending die adjacent the ram means.

3. The improvement of claim 1, including spring means for biasing said bending die outwardly from said ram means.

4. The improvement of claim 1, wherein said mounting means includes hook means to retract said bending die from the bent tubing.

5. The improvement of claim 1, wherein said mounting means includes a pair of retractor hooks that extend outwardly from said ram means on opposite sides of said predetermined path, and wherein said bending die includes means for detachably engaging said hooks during retraction of said ram means.

6. The improvement of claim 5, wherein said means for detachably engaging said hooks comprises a pair of lugs which project downwardly from the underside of the bending die, wherein the hooks vertically interlock with the lugs during retraction of said ram means.

7. The improvement of claim 6, wherein said predetermined path is provided by a guide rail, and wherein said lugs cooperate with said guide rail to align said bending die thereon, such that said bending die is prevented from straying from said predetermined path while in motion.

8. A tube bending machine for bending metal tubing, or the like, said machine comprising:

a pair of back gates;

bearing means pivotally supporting said back gates for swinging movement relative to respective axes between a substantially side-by-side closed position and an open position pivoted outwardly in opposite directions from each other;

a pair of backshoe dies mounted respectively on said back gates;

a guide rail;

a bending die including means for tracking said bending die along said guide rail;

ram means carrying said bending die and operable to advance and retract said bending die along said guide rail, said ram means including a pair of retractor hooks; and means for biasing said bending die outwardly from said ram means, wherein said ram means advances said bending die along said guide rail toward said back gates, said backshoe dies cooperating with said bending die upon advancement thereof to support the tubing, and said back gates reacting to advancement of the bending die to pivot outwardly in opposite directions from said closed position toward said open position to bend the tubing, and wherein said retractor hooks engage said tracking means on said bending die to retract said bending die from bent tubing as said ram means moves away from said back gates along said guide rail.

9. A tube bending machine as set forth in claim 8, wherein said bending die can be dropped into engagement with the guide rail to enable said bending die to be moved by said ram means, and wherein, following retraction of the bending die from bent tubing, the bending die can be lifted out of engagement with the retractor hooks to detach said bending die from said ram means, such that one bending die can be manually interchanged with another, differently sized bending die.

10. A tube bending machine as set forth in claim 8, wherein the means for biasing includes at least one spring disposed between said bending die and said ram means, wherein the tracking means includes a pair of lugs which project downwardly from the underside of the bending die.

11. A tube bending machine as set forth in claim 10, wherein the hooks capture heads of the lugs during retraction movement of said ram means.

12. A tube bending machine as set forth in claim 10, wherein said hooks are positioned adjacent opposite sides of said guide rail, wherein said lugs cooperate with said guide rail to prevent said bending die from straying to either side of said guide rail while in motion.

13. A tube bending machine as set forth in claim 8, wherein said bending die includes a pair of bolts which project downwardly from the underside of the bending die, said bending die being normally spaced outwardly from said ram means by at least one spring disposed therebetween, said at least one spring biasing said bending die into a first position whereat said bolts are spaced from said hooks, and wherein said spring compresses upon engagement of said bending die with the tubing to place said bending die in abutting relation with said ram means.

14. A tube bending machine as set forth in claim 13, wherein said hooks have an elongated length defining elongated slots at the sides of the guide rail, wherein the bending die is attached to the ram means by positioning said bending die such that said bolts respectively fit within said slots and are slid within said slots outwardly from said ram means to said first position by action of said at least one spring, and wherein following a bending operation, the bending die is spaced from the ram means by sliding said bolts within said slots from a second position whereat said bolts are engaged by said hooks to said first position and lifting said bending die out of engagement with said hooks while in the first position.

15. A ram assembly for use in a tube bending machine, said ram assembly comprising:

a pusher block operable to advance and retract along a guide rail, said pusher block including a pair of retractor hooks that extend outwardly therefrom on opposite sides of said guide rail; and a bending die including means for tracking said bending die along said guide rail, wherein said tracking means are engaged by said hooks during retraction of said pusher block such that the hooks pull the bending die and enable the pusher block to retract said bending die.

16. A ram assembly as set forth in claim 15, wherein said bending die is normally biased outwardly from said pusher block.

17. A ram assembly as set forth in claim 15, wherein said hooks are elongated and cooperate with said guide rail to define elongated slots, wherein said tracking means comprises a pair of downwardly projecting lugs provided on the underside of the bending die, and wherein said bending die attaches to said pusher block in a drop-in manner by positioning said lugs within said slots.

18. A ram assembly as set forth in claim 17, wherein said lugs cooperate with said guide rail to align said bending die thereon, such that said bending die is prevented from straying from a predetermined path while in motion.

19. A ram assembly as set forth in claim 17, wherein said lugs are defined by bolts, and wherein said retractor hooks vertically interlock with the heads of the bolts such that the bending die is prevented from rising during retraction of said bending die from said bent tubing.

20. A ram assembly as set forth in claim 17, further including at least one spring disposed between said bending die and said pusher block for normally biasing said bending die outwardly from said pusher block to a position whereat the bolts of the bending die are not in engagement with said hooks.

* * * * *